US005386988A

United States Patent [19]

Sung et al.

[11] Patent Number: 5,386,988

[45] Date of Patent: Feb. 7, 1995

[54] TENNIS PRACTICE DEVICE

[76] Inventors: Lan C. Sung, No.126, Lane 192, Sec. 1, Feng Hsing Rd., Tan Tzu Hsiang, Taichung Hsien; Chin M. Huang, No. 10, Lane 227, Li Jen Rd., Ta Li Hsiang, Taichung Hsien; Lan K. Sung, 4th Fl., No. 24-3, Lane 74, Sec. 4, Hsing Lung Rd., Taipei, all of Taiwan, Prov. of China

[21] Appl. No.: 70,886

[22] Filed: Jun. 3, 1993

[51] Int. Cl.[6] ..... A63B 69/00

[52] U.S. Cl. ..... 273/29 A; 273/26 R

[58] Field of Search ..... 273/29 A, 26 R, 26 E, 273/184 B, 185 C, 185 P, 200 R, 200 B

[56] References Cited

U.S. PATENT DOCUMENTS

| | | | |
|---|---|---|---|
| 3,006,647 | 10/1961 | Haskett | 273/26 E |
| 4,531,734 | 7/1985 | Herrick | 273/29 A |
| 4,989,867 | 2/1991 | Herrick | 273/26 R |
| 5,035,424 | 7/1991 | Liao | 273/29 A |
| 5,203,558 | 4/1993 | An | 273/26 E |

FOREIGN PATENT DOCUMENTS

| | | | |
|---|---|---|---|
| 2548914 | 1/1985 | France | 273/29 A |

*Primary Examiner*—Theatrice Brown

*Attorney, Agent, or Firm*—Charles E. Baxley

[57] ABSTRACT

A tennis practicing device includes a foldable base frame assembly, a tube pivotally mounted on the base frame assembly, and a ball returning assembly mounted in the tube. The ball returning assembly includes a tubular member consisting of an upper elastomeric section and a lower rigid section, a spring position in the tubular member, and a connecting member. A tennis ball is pre-drilled in its diameter before it is mounted to the ball returning assembly. The connecting member passes through the holes of the ball until an enlarged head end of the member grips the surface of the ball. A first end of the spring is attached to a tail end of the connecting member and the second end of the spring is attached to the lower end of the lower rigid section. The tube has a engaging means, in the form of a knob in an upper portion of the tube to clamp releasably the ball returning means.

4 Claims, 9 Drawing Sheets

TENNIS PRACTICE DEVICE

BACKGROUND OF THE INVENTION

The present invention relates to a tennis practicing device and, more particularly, to a tennis practicing device which allows a practicer to practice various tennis strokes and skills.

Current tennis practicing devices generally have a bulky volume and can be used merely to practice a few tennis stroke and/or skills. Other tennis strokes and skills, such as a smash stroke and a cut stroke, cannot be practiced. In addition, a tennis ball for practicing must be made from special material, such special material results in inconvenience when the practicing ball is damaged and thus requires replacement. It is found further that the wrist of the practicer tends to be injured during practice as momentum of a returned tennis ball is several times that in a real game, which momentum might also damage the tennis racket.

Therefore, there has been a long and unfulfilled need for an improved tennis practicing device to mitigate and/or obviate the above-mentioned drawbacks.

SUMMARY OF THE INVENTION

The present invention provides a practicing device which includes a foldable base frame assembly, a tube pivotally mounted on the base frame assembly, and a ball returning means mounted in the tube.

The ball returning means includes an upper elastomeric section and a lower rigid section, a spring positioned in the ball returning means, and a connecting member. The tennis ball is pre-drilled in diameter before it is mounted to the ball returning means. The connecting member passes through the holes of the ball until an enlarged head end thereof contacts a surface of the ball. A first end of the spring is attached to a tail end of the connecting member and the second end of the spring is attached to a lower end of the rigid section. The tube has an engagement means which takes the form of a knob formed in an upper portion thereof to clamp releasably, the lower rigid section of the ball returning means and with it the upper elastomeric section thereof.

By such arrangement, during practicing, the ball moves away from the practicer when hit, and then returns to its original position by force of the spring.

In another embodiment of the ball returning means, the lower rigid section is omitted and the spring is directly attached to the lower end of the elastomeric section.

Height and angular position of the ball can be adjusted. In addition, adjustment of inclination angle of the tube also is accommodated. By such an arrangement, the practicer may practice many tennis strokes and skills, such as a flat drive, a forehand stroke, a backhand stroke, a cut, and smash, even an overhead smash.

Other objects, advantages, and novel features of the present invention will become more apparent from a following detailed description of preferred embodiments of the invention when taken in conjunction with accompanying drawings.

DETAILED DESCRIPTION OF THE PREFERRED EMBODIMENTS

Figure 1:
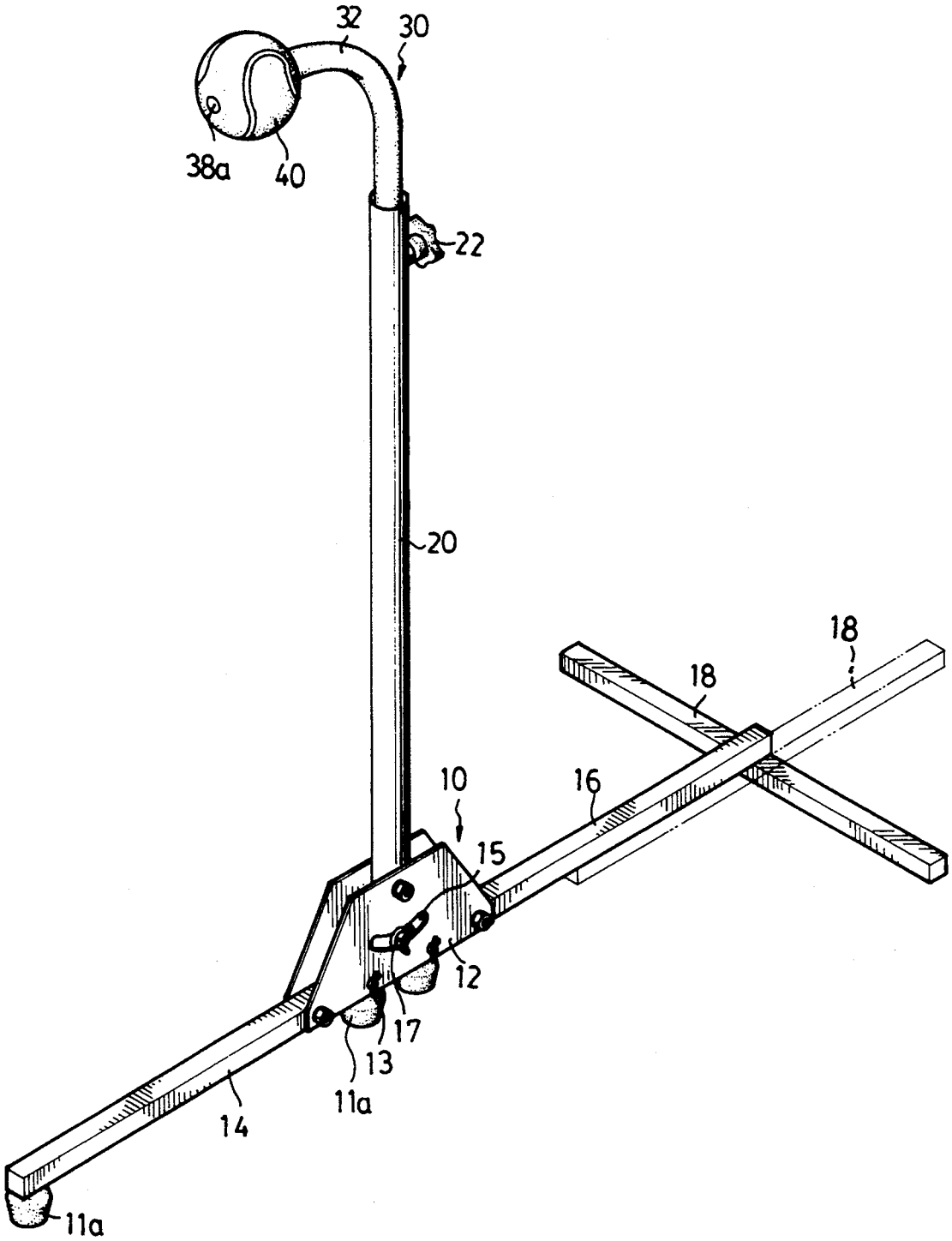
FIG. 1 is a perspective view of a tennis practicing device in accordance with the present invention.
Figure 2:
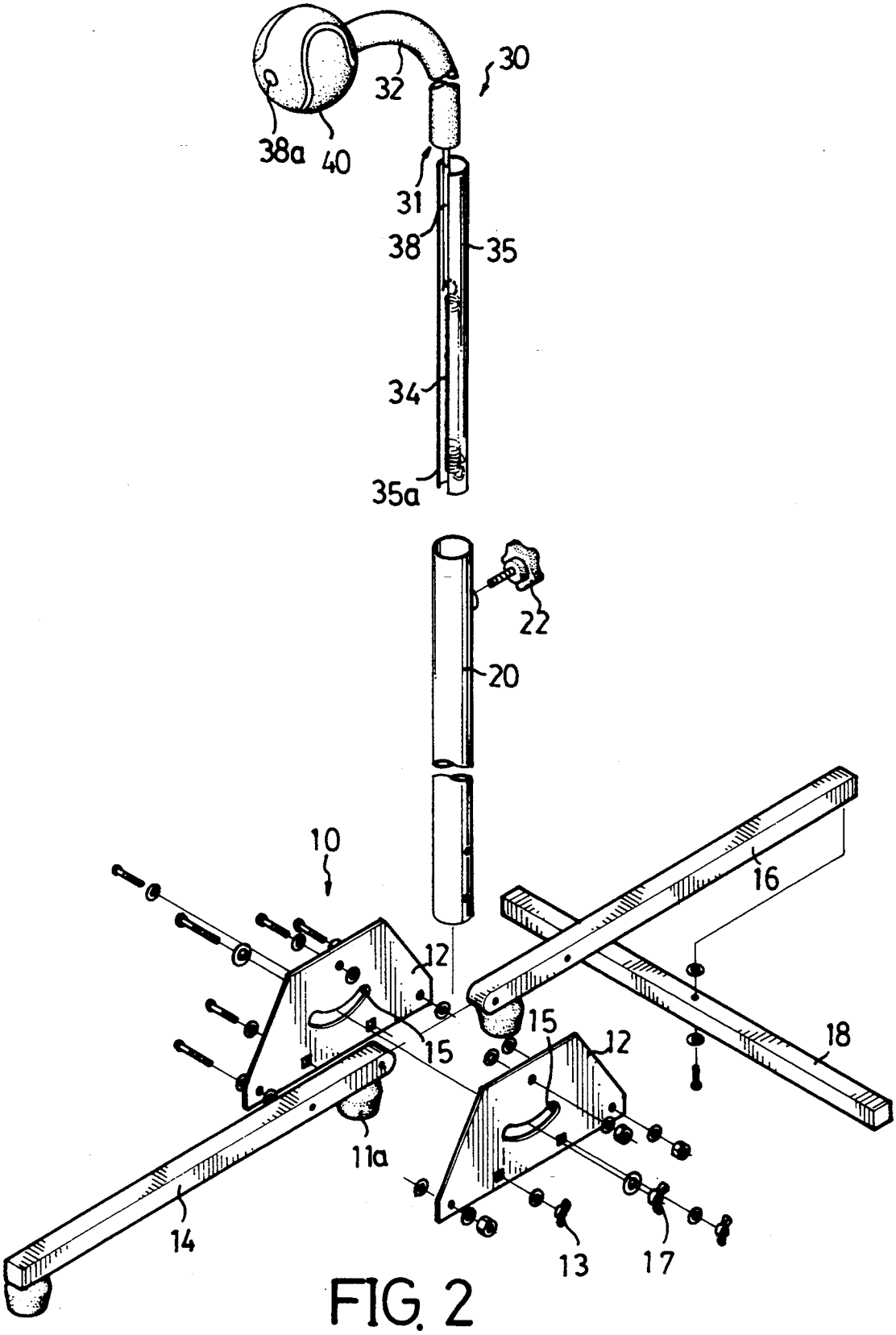
FIG. 2 is an exploded view of the tennis practicing device.
Figure 3:
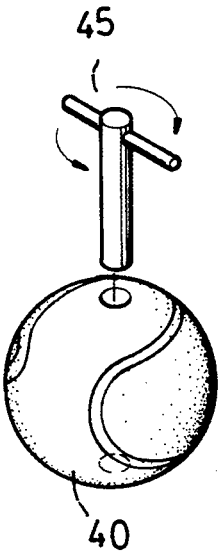
FIG. 3 is a view illustrating the opening of holes on a tennis ball.

Referring to the drawings and initially to FIGS. 1 through 4, a tennis practicing device in accordance with the present invention includes a base frame assembly generally designated 10, a tube 20 pivotally mounted on the base frame assembly 10, and a ball returning means generally designated 30 mounted in the tube 20. As shown in FIG. 2, the base frame assembly 10 includes a pair of spaced mount plates 12, a first beam member 14 extends outwardly in a longitudinal direction of the mount plates 12 and has a proximal end mounted pivotally to first margins of the mount plates 12 by bolts and nuts (not labeled), a second beam 16 outwardly extends outward in a direction opposite to that of the first beam 14 and has a proximal end mounted pivotally to second margins of the mount plates 12, and a third beam 18 which is mounted pivotally to a distal end of the second beam 16 at a mediate portion thereof, such that the third beam 18 may be pivoted to a direction aligning with the first and second beams 10 and 20 when not in use (see the phantom lines in FIG. 1).

Figure 4:
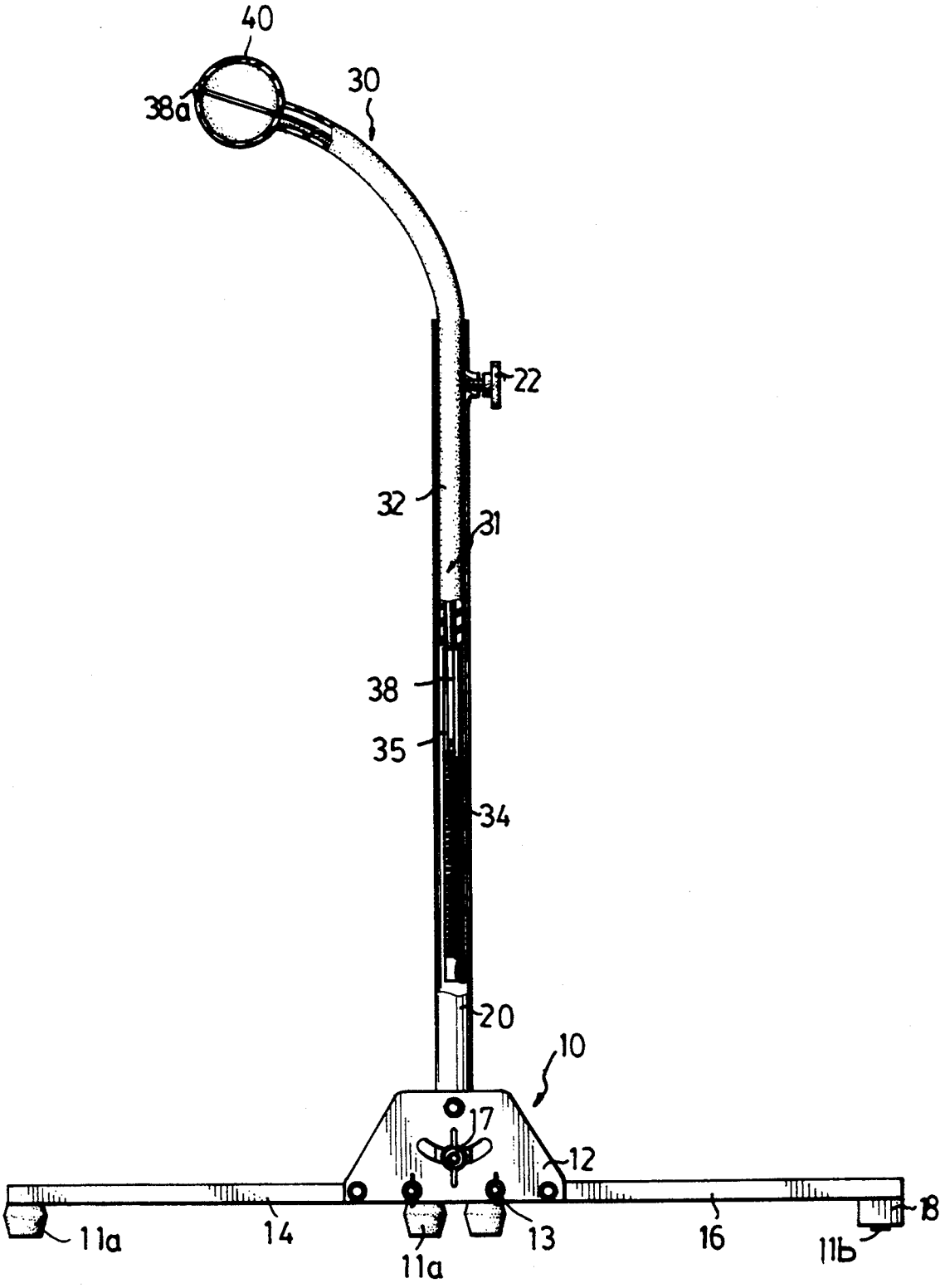
FIG. 4 is a side view, partly sectioned, of the tennis practicing device.
Figure 10:
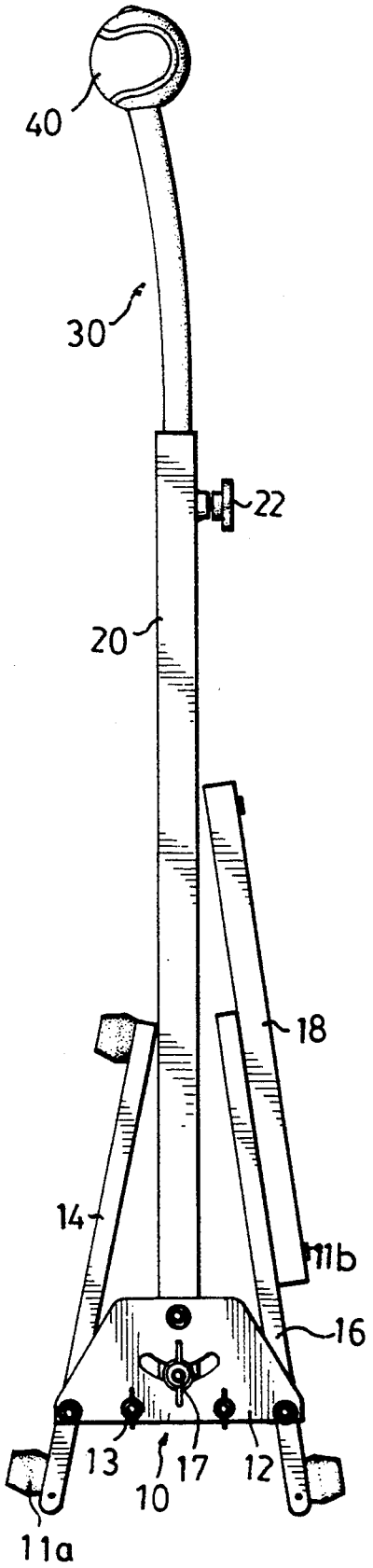
FIG. 10 is a view of the practicing device in a folded status.

By such an arrangement, the practicing device may be extended to a status shown in FIGS. 1 and 4, and the first and second beams 14 and 16 may be locked in position by suitable fastening means, such as butterfly nuts 13 and bolts (not labeled) to provide a stable support when in use. Alternately, the practicing device can be folded for easy transportation and storage, as shown in FIG. 10. As shown in the figures, preferably, dampeners **11*a* and 11*b* may be provided to undersides of the beams 14, 16, and 18** to absorb shocks.

Referring to FIGS. 2 and 4, the ball returning means 30 include a neck means 31 consisting of an curved upper elastomeric section 32 and a lower straight rigid section 35, a spring 34 received in the rigid portion 35, and a connecting pin 38. The tennis ball 40 is pre-drilled in a diameter thereof by a conventional hole opener 45 before it is mounted to the returning means 30. Preferably, the rigid tubular member 35 has a longitudinal slit **35*a* (see FIG. 2) to allow insertion of the spring 34 therein and the connecting pin 38. As shown in FIGS. 2 and 4, the connecting pin 38 passes through the holes of the ball 40 until an enlarged head end 38*a* thereof contacts a surface of the ball 40, thereby retaining the ball 40 between the enlarged head end 38*a* and an upper end of the upper elastomeric section 32 which extends telescopically out of the tube 20. A first end of the spring 34 is attached to the other end of the connecting pin 38 and the second end of the spring 34 is attached to the lower end of the lower rigid section 35. The tube 20 has an engagement means shown as a knob 22 formed in an upper portion thereof to clamp releasably the elastomeric section 32**.

Figure 8:
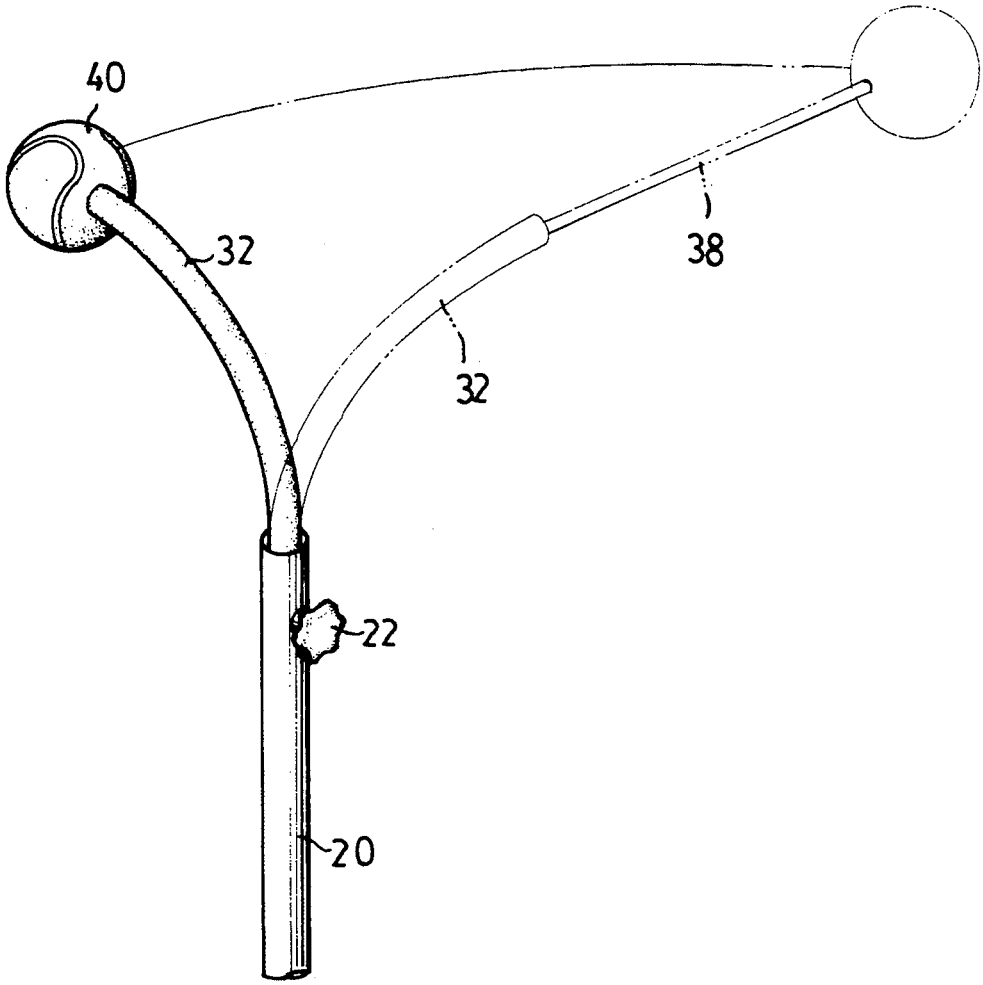
FIG. 8 is a view illustrating the motion of the practicing device during practicing.

As shown in FIG. 8, during practicing, the ball 40 moves away from the practicer when hit (see the phantom lines), and then returns to its original position by the force of the spring.

Figure 6:
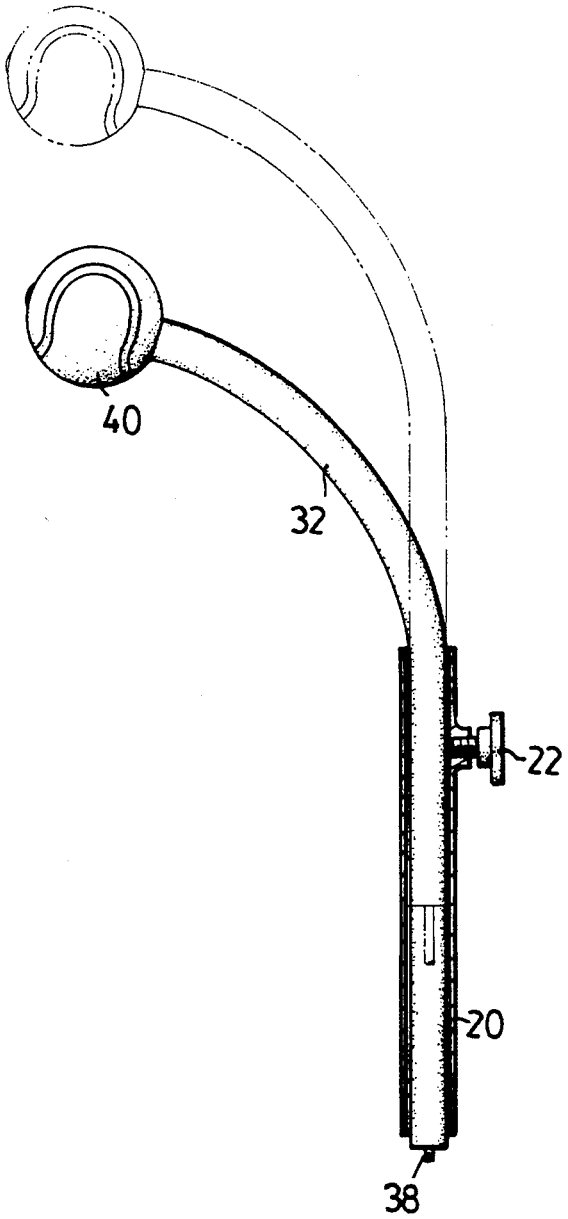
FIG. 6 is a view illustrating adjustment of height of the practicing device.
Figure 5:
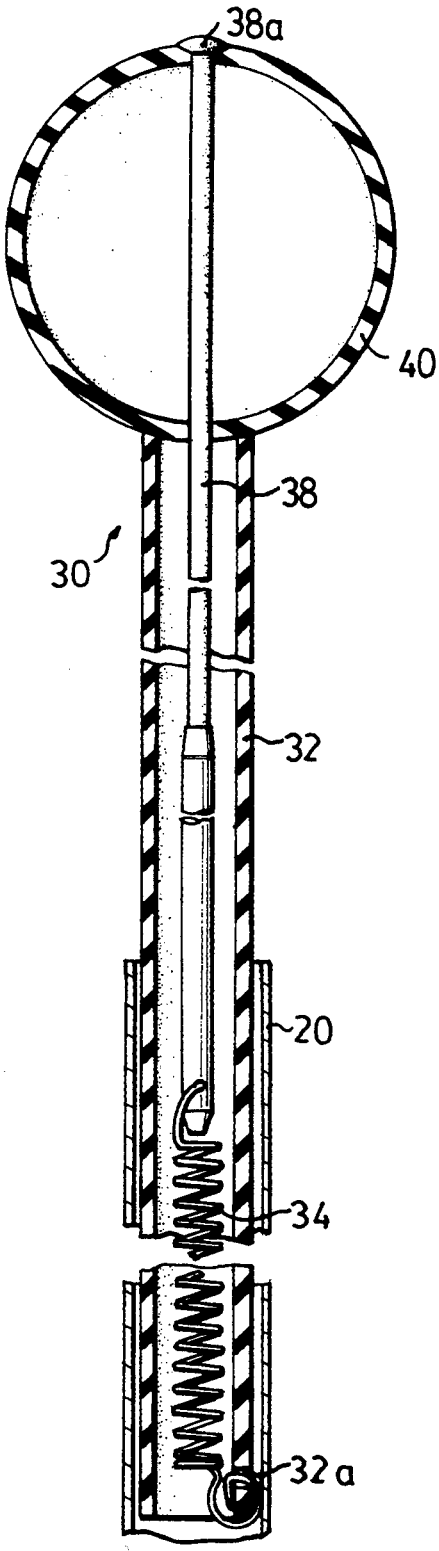
FIG. 5 is a cross-sectional view showing another embodiment of the ball returning means of the practicing device.
Figure 7:
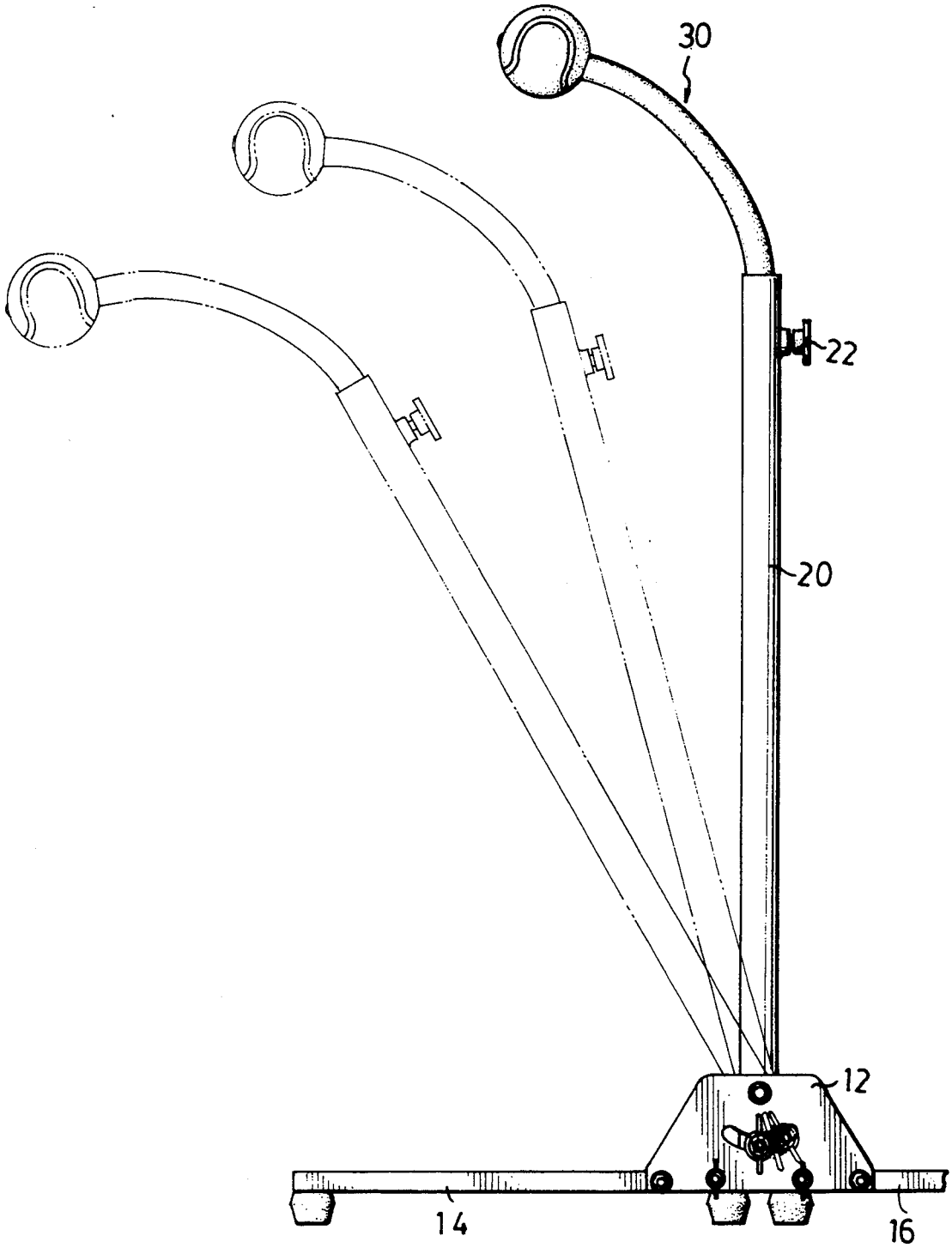
FIG. 7 is a view illustrating adjustment of angle of the tube of the practicing device.
Figure 9:
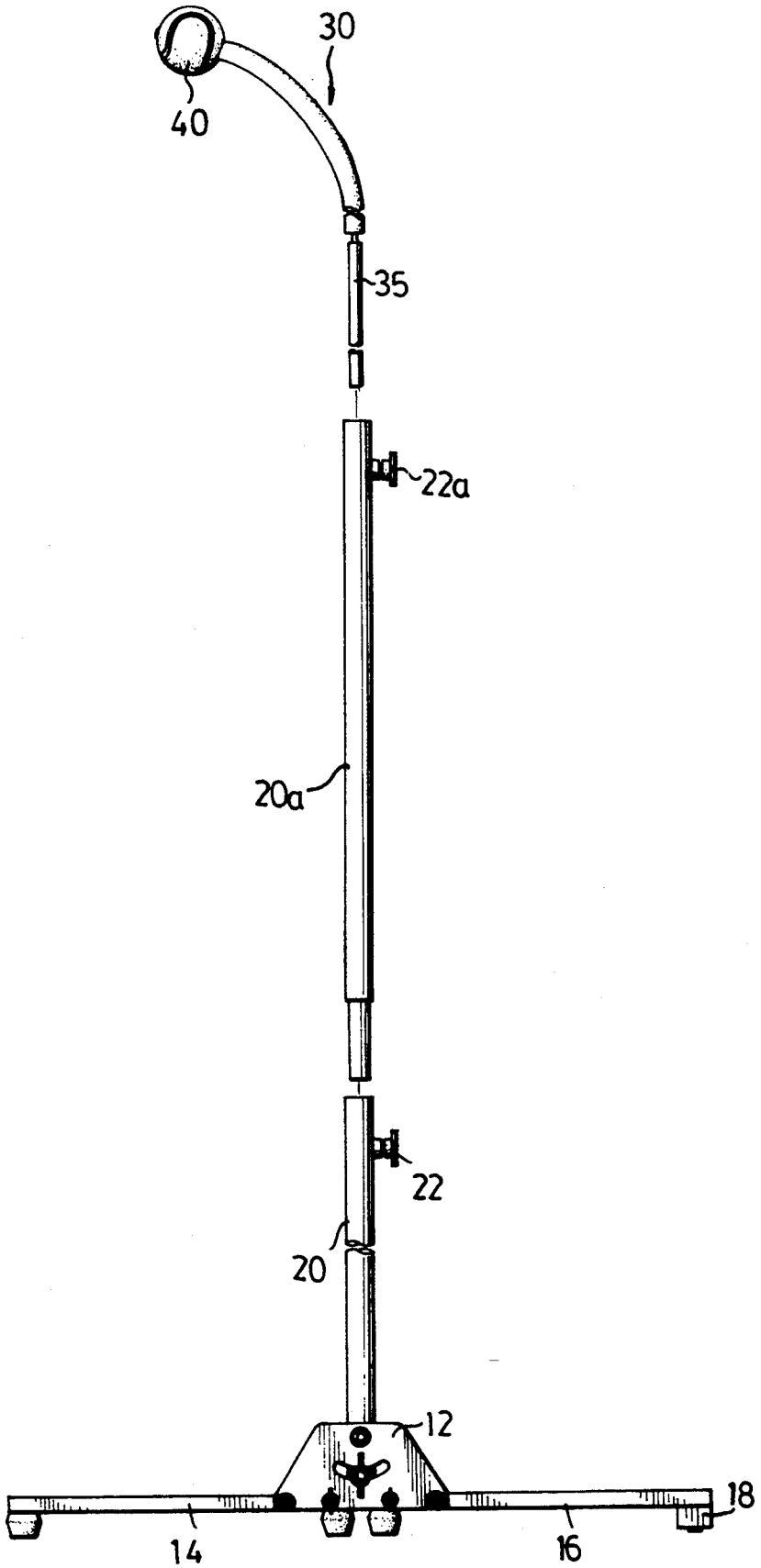
FIG. 9 is a side view illustrating another embodiment of the practicing device.

FIG. 5 shows another embodiment of the ball-returning means 30 in which the lower rigid section is omitted and the spring 34 is attached directly to an aperture 32*a* in the lower end of the elastomeric tubular means 32. FIG. 6 shows adjustment of the height of the ball. It is appreciated that the angular position of the ball also can be adjusted by control of the angular position of the elastomeric member 32. FIG. 7 shows adjustment of the inclination angle of the tube 20. By such an arrangement, the practicer may practice many tennis strokes and skills, such as a flat drive, a forehand stroke, a backhand stroke, a cut, etc. FIG. 9 shows an alternate embodiment of the practicing device in which a second tube 20*a* with a second connector, shown as knob 22*a*, is added above the tube 20 such that the practicer may practice smash strokes even overhead smash strokes.

Although the invention has been explained in relation to its preferred embodiment, it is to be understood that many other possible modifications and variations of the invention can be made without departing from a spirit and scope of the invention as hereinafter claimed.

I claim:

1. A tennis practice device comprising: a base frame assembly; a tube mounted pivotally on said base frame assembly; a ball returning means including:

a straight lower rigid portion received telescopically in said tube and a curved upper elastomeric portion extending out of said tube and having an upper end, a connecting member in said lower rigid portion and extending through the upper elastomeric portion and having an enlarged head end for retaining a tennis ball between said head and said upper end, a spring having a first spring end attached to a tail end of said connecting member and a second spring end attached to a lower end of said lower rigid portion; and means for retaining releasably said lower rigid portion in said tube, said base frame assembly including a pair of spaced mount plates spaced parallel to each other, a first beam aligned with an extending outwardly from the mount plates and having a first proximal end mounted pivotally to first margins of the mount plates, a second beam aligned with and extending outwardly from the mount plates in a direction opposite to that of the first beam and having a second proximal end mounted pivotally to second margins of the mount plates, and a third beam mounted transversely to a distal end of said second beam.

2. The tennis practice device as claimed in claim 1, wherein said third beam is mounted pivotally to the distal end of said second beam at a mediate location thereon.

3. A tennis practice device comprising: a base frame assembly; a tube mounted pivotally on said base frame assembly; and a ball returning means including:

an elastomeric tubular member having a lower portion received telescopically in said tube and a curved upper elastomeric portion extending out of said tube and having an upper end, a connecting member extending through said elastomeric tubular member and having an enlarged head end for retaining a tennis ball between said head end and said upper end of said elastomeric tubular member, and a spring having a first spring end attached to a tail end of said connecting member and a second spring end attached to a lower end of said tubular member; and engaging means provided on the tube for retaining releasably the elastomeric tubular member in the tube, said base frame assembly including a pair of mount plates spaced parallel to each other, a first beam aligned with and extending outwardly from the mount plates and having a first proximal end mounted pivotally to first margins of the mount plates, a second beam aligned with and extending outwardly from the mount plates in a direction opposite to that of the first beam and having a second proximal end mounted pivotally to second margins of, and a third beam mounted transversely to a distal end of said second beam.

4. The tennis practice device as claimed in claim 6 wherein said third beam is mounted pivotally to the distal end of said second beam at a mediate location thereon.

* * * * *